US005986540A

United States Patent [19]

Nakagaki et al.

[11] Patent Number: 5,986,540

[45] Date of Patent: Nov. 16, 1999

[54] SOUND SIGNAL GENERATING DEVICE

[76] Inventors: Koutaro Nakagaki, 4-30-3 Ikegami, Ota-Ku, Tokyo; Yukio Matsuda, 798-5 Shikawatari, Yotsukaido, Chiba-Ken; Kenzou Hoshino, 16-21 Daikan-Chou, Hiratsuka, Kanadawa; Kinya Nakao, 1395-45 Katakua-Chou, Hachiouji, Tokyo, all of Japan

[21] Appl. No.: 08/933,110

[22] Filed: Sep. 18, 1997

[51] Int. Cl.[6] ..... G08B 13/10

[52] U.S. Cl. ..... 340/384.7; 340/384.5; 340/384.71; 340/692; 340/693.3

[58] Field of Search ..... 340/384.1, 384.3, 340/384.4, 384.5, 384.7, 384.71, 321, 692, 693.3

[56] References Cited

U.S. PATENT DOCUMENTS

| | | | |
|---|---|---|---|
| 4,472,069 | 9/1984 | Yamamoto | 368/273 |
| 4,926,159 | 5/1990 | Bartlett | 340/384.6 |
| 5,604,479 | 2/1997 | Chang | 340/384.7 |
| 5,754,094 | 5/1998 | Frushour | 340/384.7 |
| 5,883,573 | 3/1999 | Mazeiko, Jr. et al. | 340/506 |

*Primary Examiner*—Edward Lefkowitz
*Attorney, Agent, or Firm*—Pennie & Edmonds LLP

[57] ABSTRACT

A sound signal generating device capable of generating an alarm sound signal and voice signal for a prolonged period of time having a power supply, a memory for storing data in relation to a help sound signal digitally, a D/A converting circuit for converting the stored data into an analog signal, a sound output circuit for outputting the help sound signal in response to the analog signal and a switching circuit for selectively applying the power supply to the sound output circuit when being activated by a control signal. The sound signal generating device also has a control circuit for generating a first control signal to enable a successive reading of the stored data and activate the switching circuit at the same time of the reading and for generating a second control signal when the reading is completed to deactivate the first control signal for a predetermined interval and then reset the same. When the first control signal is deactivated during the predetermined interval, the switching circuit disables the sound output circuit to thus minimize the consumption of power supply.

20 Claims, 2 Drawing Sheets

SOUND SIGNAL GENERATING DEVICE

FIELD OF THE INVENTION

The present invention generally relates to a sound signal generating device capable of continuously generating an audible signal for a prolonged period of time. More particularly, the present invention relates to a help voice generator capable of generating an alarm signal or a voice signal asking for help in case of an emergency, especially as may occur in a deserted area.

BACKGROUND OF THE INVENTION

Portable self-protection alarms have been used for alarming purposes in emergency cases of both crime encounters such as theft and rape attempts and natural calamities such as earthquakes and accidents. Such portable self-protection alarms include help voice generators and alarm buzzers. They typically have a battery and a sound generator, such as a voice generator or a buzzer, which are contained in a compact case so that they can be easily carried around. These alarms are designed to generate a very loud sound, when a lever or the like on the alarm is actuated, to thereby sound the alarm for emergency.

When these self-protection alarms are being used, especially in deserted areas such as the mountains, they are usually required to operate for a prolonged period of time such as an entire day or even longer. However, conventional self-protection alarms cannot practically generate a voice or alarm for such a prolonged period of time because they use batteries for power supply.

In addition, there always exists the problem that the volume of the generated sound decreases as the battery is being consumed with the passage of time. Even if the power consumption is minimized in order to operate the alarm for a longer period of time, the volume of the generated sound will eventually decrease, and therefore the alarm will fail to perform its function.

Therefore, it is desirable to provide a sound signal generating device capable of generating an alarm sound signal or voice signal for a prolonged period of time. The present invention provides a sound signal generating device which meets all the requirements.

SUMMARY OF THE INVENTION

A primary object of the present invention is to solve the problems underlying the prior art.

Another object of the present invention is to provide a sound signal generating device which is capable of generating an alarm sound signal or a voice signal for a prolonged period of time.

A further object of the present invention is to provide a sound signal generating device which is capable of recording identification information for assisting in identifying a missing child in such as an amusement park.

A still further object of the present invention is to provide a sound signal generating device which is capable of wirelessly transmitting a sound signal so that the range of rescue activities can be extended.

For accomplishing the above objects, the sound signal generating device of the present invention comprises a power supply, a first memory for digitally storing data in relation to a first sound signal, a D/A converting circuit for converting the data stored in the memory to an analog sound signal, a sound output circuit for receiving the analog sound signal and outputting the first sound signal and a switching circuit for selectively applying the power supply to the sound output circuit when being activated by a first control signal. The sound signal generating device further comprises a control circuit for generating a first control signal to enable a successive reading of the stored data and activate the switching circuit at the same time of the reading and for generating a second control signal when the reading is completed to deactivate the first control signal for a predetermined interval and then reset the same.

According to the present invention, the switching circuit disables the sound output circuit when the first control signal is deactivated during the predetermined interval. The predetermined interval can range from 0 to 80 seconds and, preferably, from 10 seconds to 30 seconds. Therefore, the sound output circuit consumes power supply in an intermittent pattern and the power consumption of the sound signal generating device is minimized.

In the sound signal generating device of the present invention, the first memory comprises a sound source data ROM for storing the data and an address counter. The stored data comprises a first group of data in relation to an alarm sound signal and a second group of data in relation to a voice signal. The second group of data is preceded by the first group of data. Preferably, the alarm sound signal is a continuous alarm with a frequency ranging from 1500 Hz to 3000 Hz and the voice signal is a human voice or cry for "Help!".

In a preferred embodiment, the second group of data comprises a plurality of sections in relation to different voice signals. There can be two sections of data which are in relation to a female and a male voice of "Help!" In alternative, the two sections of data in the second group can be in relation to English and Japanese languages of "Help!". A selector switch is provided in the sound signal generating device for selecting between the plurality of sections of data in the first memory. As a result, the application of the sound signal generating device is extended.

The sound output circuit can comprise an audio amplifying circuit and a speaker member for transmitting an audible signal. In alternative, the sound signal generating device can comprise a radio wave generating circuit for transmitting the sound signal by a radio wave.

The switching circuit can have a transistor, preferably, a pnp bipolar transistor. Such transistor has an emitter connected to a power supply, a collector connected to the sound output circuit and a base connected to the control circuit for receiving the first control signal.

The first control signal generated by the control circuit can comprise a series of pulses. Each pulse can have a high level for enabling the reading of the stored data and a low level for terminating the reading. In a preferred embodiment, the first control signal has three pulses.

The sound signal generating device of the present invention can further comprise a microphone for receiving a second sound signal, an A/D converting circuit for converting the second sound signal into digital data and a second memory for storing the digital data in relation to the second sound signal. The second sound signal is preferably a voice signal containing information for the name, address, and contact person of a user. Such facilities are especially applicable for locating a missing child.

The sound signal generating device of the present invention can only use at least one battery as power supply. In a preferred embodiment, there are two AA alkali batteries.

BRIEF DESCRIPTION OF THE DRAWINGS

These and other features, aspects, and advantages of the present invention will become much more apparent from the following description, appended claims, and accompanying drawings, in which:

DETAILED DESCRIPTION OF THE PREFERRED EMBODIMENT

Figure 1:
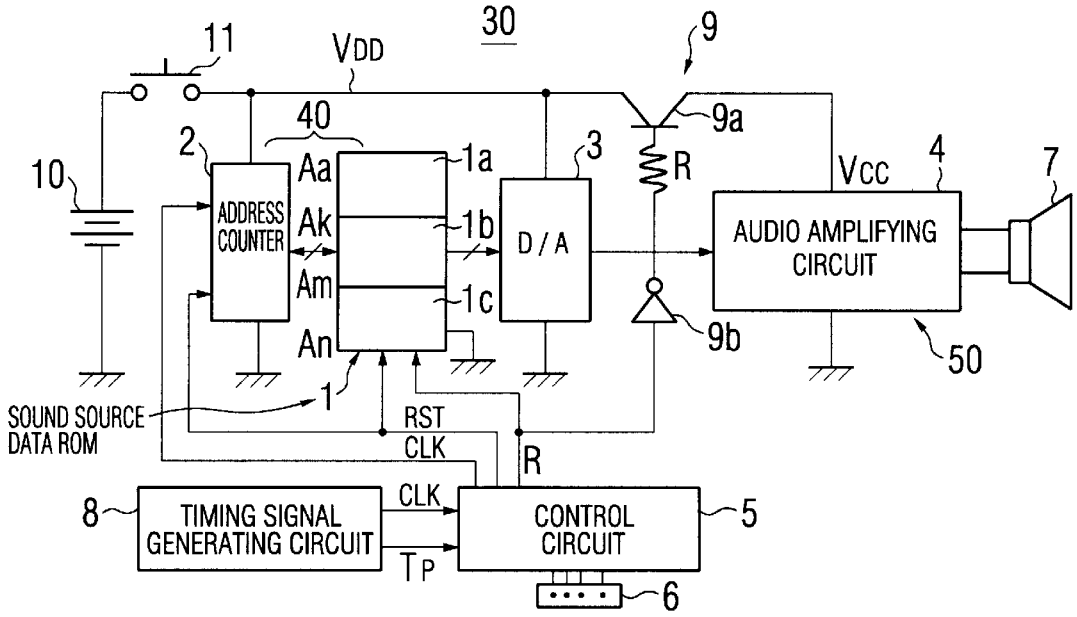
FIG. 1 is a block diagram of a sound signal generating device of a preferred embodiment of the present invention.
Figure 2A:
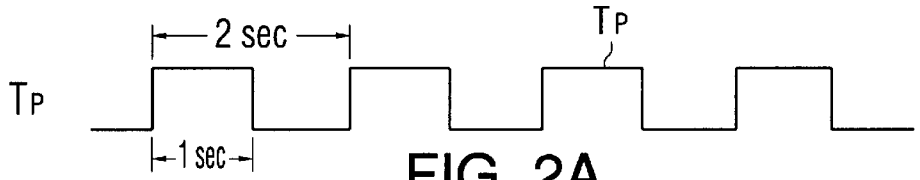
FIG. 2 is a timing chart showing the operations of the sound signal generating device shown in FIG. 1.
Figure 2B:
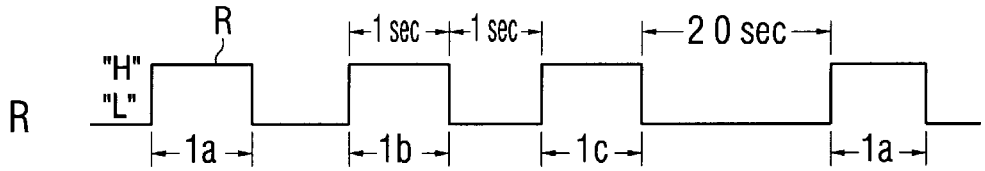
Figure 2C:
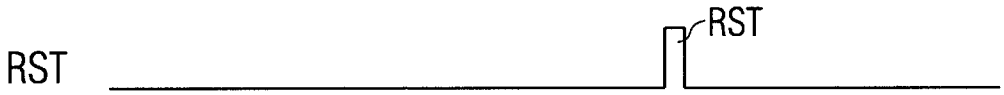
Figure 2D:
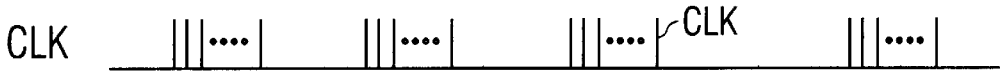
Figure 3:
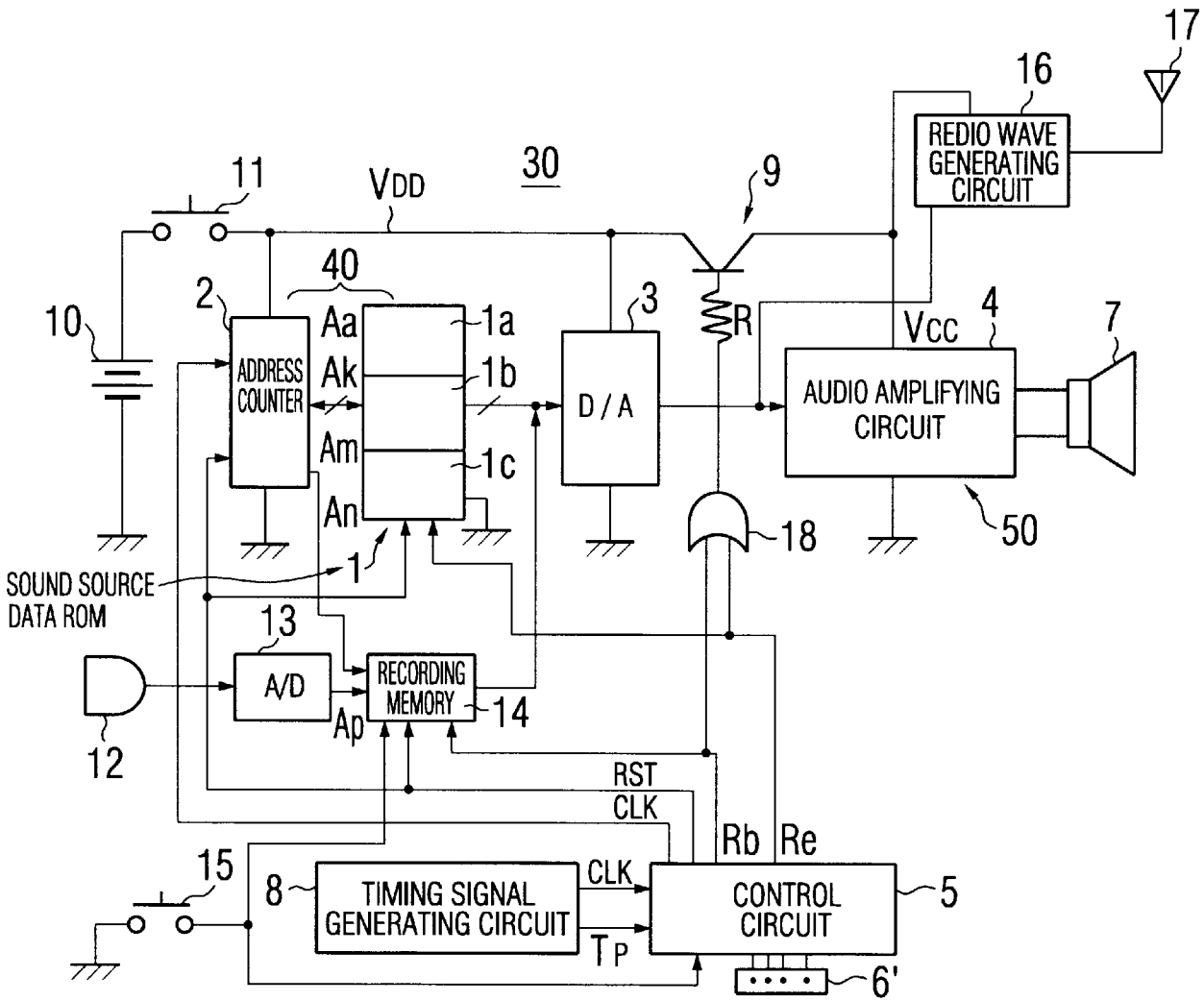
FIG. 3 is a block diagram of a sound signal generating device of the present invention with additional expansion facilities.

Various sound signal generating devices embodying the principles of the present invention are illustrated in FIGS. 1–3. These sound signal generating devices of the present invention are capable of generating an alarm sound signal or a voice signal for a prolonged period of time. In each embodiment, the same elements are designated with the same reference numerals and repetitive descriptions are omitted.

Referring to FIG. 1, a sound signal generating device of the present invention is generally designated by reference numeral 30. The sound signal generating device 30 comprises a first memory 40 including a sound source data ROM 1 and an address counter 2. The sound source data ROM 1 has data in relation to an alarm sound signal 1*a* and a help voice signal 1*b*, 1*c* stored therein. The address counter 2 produces an address of the sound source data ROM 1 to be accessed. A D/A converting circuit 3 converts data read from the sound source data ROM 1 into an analog signal. A sound output circuit 50 is provided having an audio amplifying circuit 4 amplifying the alarm sound signal 1*a* and the voice signal 1*b*, 1*c* in response to an output of the D/A converting circuit 3.

The sound signal generating device 30 further comprises a control circuit 5 for generating various control signals, a speaker 7 for outputting an alarm sound signal 1*a* and a voice signal 1*b*, 1*c*, a timing signal generating circuit 8, a switching circuit 9, a battery 10 and an operation switch 11, which are electrically connected with each other and the components mentioned hereinabove. The control circuit 5 is adapted to successively access the data stored in the sound source data ROM 1 so as to successively read data constituting a help sound signal, repeatedly carry out the reading at intervals of a given cycle of several seconds or more after reading the help sound signal is completed and generating a control signal used to turn on the switching circuit 9 at the time of reading. When the operation switch 11 is actuated, operating power is supplied from the battery 10 to all the circuits except for the sound output circuit.

The control circuit 5 includes an interval selector switch 6 for changing an interval between repetitions of reading. With the interval selector switch 6, the interval between repetitions of reading can be adjusted.

FIG. 3 shows a second preferred embodiment of the present invention in which additional expansion facilities are incorporated. In this preferred embodiment, reference numeral 6' denotes a selector switch for specifying the contents of a voice or a combination of voices. In addition, there are provided a microphone 12, an A/D converting circuit 13 for converting a voice signal output from the microphone into digital data, a memory 14 for receiving and storing an output of the A/D converting circuit 13, a record switch 15 to be handled to record data, a radio wave generating circuit 16 for modulating a voice signal output from the D/A converting circuit 13 and outputting a radio wave and an antenna 17.

In the sound source data ROM 1, part of a ringing alarm sound signal 1*a* is developed digitally and stored at addresses Aa to Ak. The ringing alarm sound signal 1*a* corresponds to 1 second defined by the cycle of a clock CLK generated by the timing signal generating circuit 8 as a reference. A female voice signal 1*b* of "Help!" is stored at succeeding addresses Ak+1 to Am. Further, a voice signal 1*c* of "Help!" is then stored at succeeding addresses Am+1 to An.

The sound source data ROM 1 is manufactured by temporarily storing an alarm sound signal 1*a* and a female voice 1*b* of "Help!" digitally in a memory using a digital voice memory unit and, then, reforming the memory so that the memory permits only reading of digital data. The alarm sound signal 1*a* is a ringing sound with frequencies centered on 2000 Hz. More preferably, for better attracting attention, the frequency of the ringing sound is selected in the range of between 1500 Hz and 3000 Hz.

The timing signal generating circuit 8 transmits, to the control circuit 5, a clock CLK having a given cycle and a timing pulse $T_p$ (see FIG. 2*a*) having a duty cycle of 50% and a cycle of 2 seconds. The control circuit 5 has a preset counter (not shown) therein, which allows to generate three output pulses in response to three timing pulses $T_p$. Thereafter, ten timing pulses $T_p$ are counted before another three output pulses are generated in response to three timing pulses $T_p$. The output pulses are transmitted as a reading control signal R (see FIG. 2*b*) to the sound source data ROM 1. In other words, three output pulses each going high for one second and low for one second are generated at an interval of 20 seconds.

The cycle of the clock CLK is set to a value confining the time required to complete access to addresses, at which digital data of the alarm sound signal 1*a* and digital data representing the voice signals 1*b*, 1*c* of "Help!" is stored for one second or shorter. Preferably, an address storing data of an inaudible sound is interposed between the addresses of the alarm sound signal 1*a* and those of the voice signals 1*b*, 1*c* of "Help!". Such an interposed address can prevent the voice signal from being partly deleted even if an output pulse becomes asynchronous with the clock CLK.

The address counter 2 can be reset with the clock CLK. More specifically, the control circuit 5 generates a reset signal RST, as shown in FIG. 2*c*, after generating three reading pulses R. The control circuit 5 further transmits the reset signal RST to the address counter 2. With the reset signal RST, the address value of the address counter 2 is reset to an initial value, for example "0".

The control circuit 5 transmits the clock CLK and reading control signal R to the sound source data ROM 1 and the address counter 2 respectively during a period of time when the reading signal R remains high or, in other words, for one second. Thus, while the reading control signal R remains high, digital data is read and successively output from addresses in the voice source data ROM 1, which are indicated by the address counter 2.

The sound source data ROM 1 has data read at the leading edge of the clock CLK. The count value of the address counter 2 is incremented at the trailing edge of the clock CLK. When the operation switch 11 is turned on, the reset signal RST is sent to the address counter 2 and thus the count value of the address counter 2 starts from an initial value.

The switching circuit 9 includes a pnp bipolar transistor 9*a*, and a resistor R connected to the base of the transistor 9*a*. The emitter and collector of the bipolar transistor 9*a* are connected to a terminal of the operation switch 11 over a power line $V_{DD}$ and to a power terminal $V_{CC}$ of the audio amplifying circuit 4, respectively. The reading control signal R is received through the base of the transistor 9*a*. While the reading control signal R remains high, the transistor 9*a* is on. At this time, if the operation switch 11 is turned on, power supplied from the battery 10 is supplied to the audio amplifying circuit 4.

The operation switch 11 is connected between the power line $V_{DD}$ and the battery 10. When a push-button switch is actuated externally of the sound signal generating device 30, power is supplied over the power line $V_{DD}$. The power line $V_{DD}$ is then connected with the power supply terminals of all the circuits except the audio amplifying circuit 4. When the operation switch 11 is pressed again, it is turned off.

The operation of the sound signal generating device 30 of the present invention will be described in detail with reference to FIG. 2.

When the operation switch 11 is turned on, the timing signal generating circuit 8 transmits the clock CLK and timing pulse $T_p$ to the control circuit 5. The control circuit 5 transmits the reading control signal R to both the sound source data ROM 1 and the switching circuit 9. While the reading control signal R remains high, data is read and output from the addresses in the sound source data ROM 1 indicated by the address counter 2. The address of the sound source data ROM 1 to be read is updated by the address counter 2 synchronously with the clock CLK transmitted from the control circuit 5 (see FIG. 2*a*).

As a result, digital data corresponding to an alarm sound signal 1*a* is read during the first high-level period of the reading control signal R right after the operation switch 11 is turned on. The alarm sound signal 1*a* is then converted into an analog signal. The analog signal is transmitted to the audio amplifying circuit 4, amplified by the audio amplifying circuit 4 and finally output from the speaker 7.

In the next high-level period of the reading control signal R, which is two seconds after the operation switch 11 is turned on, a voice signal of "Help!" is output from the speaker 7. In another two seconds, another voice signal of "Help!" is output from the speaker 7. The control circuit 5 then generates and transmits the reset signal RST to the address counter 2 (see FIG. 2*c*). Thereby, the address counter 2 is reset to an initial value. After a pause of 20 seconds, the foregoing procedure is repeated.

The count value of the preset counter, by which the preset counter counts the number of timing pulses $T_p$, can be changed by adjusting the interval selector switch 6. The interval, that is, the pause of 20 seconds can be changed within the range from 0 to 40 seconds. In the preferred embodiment, the count value of the preset counter is set to be 10. This results in a pause of 20 seconds long. When the count value is one, the pause is two seconds long. A count value of 20 results in a pause of 40 seconds long.

When the sound source data ROM 1, control circuit 5, timing generating circuit 8 and D/A converting circuit 3 are made with integrated circuits, such integrated circuits are usually of the CMOS logic. Even if a battery is used for power supply, the power consumption of the sound signal generating device is very small. This means that the sound signal generating device 30 of the present invention can operate for a prolonged period of time.

One major concern may exist in regard to the audio amplifying circuit 4 that must generate a loud sound. However, as apparent from the description of the preferred embodiment, the audio amplifying circuit 4 is designed to operate intermittently at intervals of several seconds or more. Therefore, the power consumption of the entire sound signal generating device 30 is minimized.

In a preferred embodiment, two AA alkali batteries are used to generate a voice signal output of 1.5 W or so. The voice signal is output for one second followed by an interval of one second. In addition, the voice output is repeated intermittently at intervals of about 20 seconds or more. In this case, the batteries are not consumed very much and thus the sound signal generating device 30 can operate for an entire day or even longer.

In this preferred embodiment, data in relation to two kinds of voice signals 1*b*, 1*c* of "Help!" are stored in the sound source data ROM 1. The address value of the address counter 2 is updated and can later be made to return to the leading address of the first voice signal 1*b* of "Help!". In this way, the leading address of the first voice signal 1*b* of "Help!" can be accessed again so that the voice signals 1*b*, 1*c* of "Help!" can be repeatedly generated. In this case, only one storing area is needed in the sound source data ROM 1 for storing the voice signal of "Help!". Nevertheless, as the storage capacity of the sound source is reduced, the control process becomes more complex.

Moreover, the generation of the voice signal of "Help!" is not limited to only twice. It may be generated three times or more with the first reading. The voice signal stored is not limited to "Help!" but may be "Help! Please!", "Fire", "Here I am!" or the like. Further, the voice signals such as "Help!" or "Fire" can be in any language, such as Japanese, or English. A selector switch 6' may be used to select any of these kinds of voice signals or any combination of the voice signals.

The frequency of the voice signal may be changed appropriately using the selector switch 6'. In a preferred embodiment, a male voice signal is also stored in the memory. The selector switch 6' may then be used to switch from a female voice signal to the male voice signal or vice versa.

The alarm sound signal 1*a* is not limited to a ringing sound but may be the sound of a siren of a patrol car or a buzzer sound. Moreover, the interval between generations of the alarm sound signal 1*a* and the voice signal 1*b*, 1*c* is set, such as one second or more. Needless to say, the interval between the alarm sound signal 1*a* and the voice signal 1*b*, 1*c* and/or between a first voice signal 1*b* and the next voice signal 1*c* may be made adjustable. Alternatively, the alarm sound signal 1*a* and the voice signal 1*b*, 1*c* may be generated continuously.

Since an alarm sound signal 1*a* always precedes a voice signal 1*b*, 1*c*, attention can be attracted more successfully than that when a help voice signal alone is generated. Moreover, since the alarm sound signal 1*a* and the help voice signals 1*b*, 1*c* are combined, the alarm sound signal 1*a* can be distinguished more easily from that generated by any other electronic equipment and therefore be recognized as a help sound signal.

For generating a help voice signal, a voice synthesizing circuit or the like may be used instead of the sound source data ROM 1 and control circuit 5. The voice synthesizing circuit includes a memory serving as a sound source and storing a phrase and a control circuit for accessing the memory and generating digital data of a given voice. However, when the voice synthesizing circuit is used, the generated voice signal may not as natural.

Description will now be made in relation to the operation of the sound signal generating device 30 according to the present invention with expansion facilities added as shown in FIG. 3.

The expansion facilities are employed for recording and reproducing information, such as the name, address and emergency contact person of the user. In recording such information, a voice message is to be transmitted through the microphone 12 while holding down the record switch 15. A microphone 12 of a compact structure, such as a capacitor microphone can be used. While the record switch 15 is held down, the "on" state signal of the record switch 15 causes the recording memory 14 to operate. Thereby, the voice message received through the microphone 12 is digitized by the A/D converting circuit 13 and then stored in the recording memory 14.

For reproducing the voice message recorded in the recording memory 14, a predetermined switch of the selector switch 6' is selected. When the operation switch 11 is turned on, the timing signal generating circuit 8 transmits the clock CLK and timing pulse $T_p$ to the control circuit 5. The control circuit 5 then transmits the reading control signal $R_b$ to the recording memory 14 alone and transmits the clock CLK to the address counter 2. When the address counter 2 provides a value $A_p$ indicating an address in the recording memory 14, the digital voice data representing the prerecorded information is sent from the recording memory 14 to the D/A converting circuit 3. Moreover, the reading control signal $R_b$ sent from the control circuit 5 turns on the transistor 9*a* via an OR circuit 18 to thereby activate the audio amplifying circuit 4.

In a further preferred embodiment, the help voice signal is transmitted in a wireless manner. In this case, the same voice signal sent to the audio amplifying circuit 4 is transmitted to the radio wave generating circuit 16. The radio wave generating circuit 16 modulates the voice signal so that the voice signal has a radio frequency that can be propagated as a radio wave in space. The radio wave generating circuit 16 then transmits the resultant radio wave through the antenna 17. Such transmission of a radio wave may be selected when needed.

As described above, the sound output circuit, among all the other components in the sound signal generating device 30, requires the largest amount of power. However, since sound signals are transmitted intermittently at intervals of several seconds or more, the consumption of power supply is minimized. Therefore, even though batteries are used for power supply in the sound signal generating device 30, such at sound signal generating device 30 can still operate for a prolonged period of time. Moreover, since the power supply is intermittent, a larger amount power can be supplied to the sound output circuit. Consequently, a loud sound, such as a sound of 80 phons or more, can be generated for a prolonged period of time.

Therefore, the sound signal generating device 30 can not only operate for a prolonged period of time, but also keep generating a loud help voice to attract attention more successfully. As a result, the sound signal generating device 30 will become an indispensable device for the user to use in case of an emergency.

In addition, when a recording facility is included, the sound signal generating device 30 proves to be effective in identifying a missing child, such as in an amusement park or the like. Further, when the help sound signal generated is transmitted through a radio wave, the transmission range of the help sound signal can be significantly broadened.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A sound signal generating device comprising:

a power supply;

a first memory for digitally storing data in relation to a first sound signal;

a D/A converting circuit for converting the data stored in the memory to an analog sound signal;

a sound output circuit for receiving the analog sound signal and outputting the first sound signal;

a switching circuit for selectively applying the power supply to the sound output circuit when being activated by a first control signal; and a control circuit for generating the first control signal to enable a successive reading of the stored data and to activate the switching circuit at the same time of the reading and for generating a second control signal when the reading is completed to deactivate the first control signal for a predetermined interval and then reset the same, wherein the switching circuit disables the sound output circuit when the first control signal is deactivated during the predetermined interval.

2. The generating device of claim 1, wherein the first memory comprises a sound source data ROM for storing the data and an address counter.

3. The generating device of claim 1, wherein the stored data comprises a first group of data in relation to an alarm sound signal and a second group of data in relation to a voice signal, the second group of data being preceded by the first group of data.

4. The generating device of claim 3, wherein the alarm sound signal is a continuous alarm with a frequency ranging from 1500 Hz to 3000 Hz and the voice signal is a human voice of "Help!".

5. The generating device of claim 3, wherein the second group of data further comprises a plurality of sections in relation to different voice signals.

6. The generating device of claim 5, wherein there are two sections of data in the second group which are in relation to a female voice and a male voice of "Help!".

7. The generating device of claim 5, wherein there are two sections of data in the second group which are in relation to English and Japanese languages of "Help!".

8. The generating device of claim 5, further comprising a selector switch for selecting between the plurality of sections of data in the first memory.

9. The generating device of claim 1, wherein the sound output circuit comprises an audio amplifying circuit and a speaker member.

10. The generating device of claim 1, wherein the switching circuit comprises a transistor having an emitter connected to a power supply, a collector connected to the sound output circuit and a base connected to the control circuit for receiving the first control signal.

11. The generating device of claim 10, wherein the transistor is a pnp bipolar transistor.

12. The generating device of claim 1, wherein the first control signal comprises a series of pulses, each pulse having a high level for enabling the reading of the stored data and a low level for terminating the reading.

13. The generating device of claim 12, wherein the first control signal has three pulses.

14. The generating device of claim 1, wherein the predetermined interval ranges from 0 second to 80 seconds.

15. The generating device of claim 14, wherein the interval ranges from 10 seconds to 30 seconds.

16. The generating device of claim 1, further comprising a microphone for receiving a second sound signal, an A/D converting circuit for converting the second sound signal into digital data and a second memory for storing the digital data in relation to the second sound signal.

17. The generating device of claim 16, wherein the second sound signal is a voice signal containing information for the name, address, and contact person of a user.

18. The generating device of claim 16, further comprising a radio wave generating circuit for transmitting at least one of the first and the second sound signals by a radio wave.

19. The generating device of claim 1, wherein the power supply comprises at least one battery.

20. The generating device of claim 19, wherein there are two AA alkali batteries.

* * * * *